US009811971B1

(12) United States Patent
Reeves

(10) Patent No.: US 9,811,971 B1
(45) **Date of Patent: *Nov. 7, 2017**

(54) USE OF MOBILE DEVICE AS A DIRECT INPUT/OUTPUT DEVICE FOR A PLAYER TRACKING SYSTEM FOR GAMING MACHINES

(71) Applicant: IVERSON GAMING SYSTEMS, INC., Bala Cynwyd, PA (US)

(72) Inventor: Millard H. Reeves, Philadelphia, PA (US)

(73) Assignee: Iverson Gaming Systems, Inc., Bala Cynwyd, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/412,673

(22) Filed: Jan. 23, 2017

Related U.S. Application Data

(63) Continuation of application No. 14/492,868, filed on Sep. 22, 2014, now Pat. No. 9,552,693.
(Continued)

(51) Int. Cl.
*G07F 17/32* (2006.01)

(52) U.S. Cl.
CPC ..... *G07F 17/3239* (2013.01); *G07F 17/3223* (2013.01); *G07F 17/3227* (2013.01); *G07F 17/3244* (2013.01)

(58) Field of Classification Search
USPC ..... 463/29
See application file for complete search history.

(56) References Cited

U.S. PATENT DOCUMENTS 6,852,031 B1 2/2005 Rowe
7,699,703 B2 4/2010 Muir et al.
(Continued)

OTHER PUBLICATIONS

"SlotScanner™ Player Tracking Module" product brochure, Advansys d.o.o., download date: Jul. 2013, original posting date: unknown, 5 pages.

(Continued)

*Primary Examiner* — Pierre E Elisca
(74) *Attorney, Agent, or Firm* — Panitch Schwarze Belisario & Nadel LLP

(57) ABSTRACT

A mobile device is used as an input/output device for a player tracking system for gaming machines, such as slot machines. Each gaming machine has a unique identifier and each player has a unique identifier that is associated with an account of the player. Player credentials are electronically communicated via the mobile device directly to the player tracking system, and each player credential is associated with a player's unique identifier that is maintained by the player tracking system. The mobile device is also used to electronically communicate directly to the player tracking system a gaming machine that the player wishes to play. Prior to initiation of game play on a gaming machine, the player tracking system associates the unique identifier of a player with the unique identifier of a gaming machine that the player wishes to play. A play session is initiated at the gaming machine and game play at the gaming machine is associated with the account of the player, and activity from the play session is captured by the player tracking system. Information is displayed on a display screen of the mobile device during the play session, including data regarding the player that is maintained in the player tracking system.

15 Claims, 24 Drawing Sheets

Mobile Device Enabled Player Tracking

Related U.S. Application Data

(60) Provisional application No. 61/881,757, filed on Sep. 24, 2013.

(56) References Cited

U.S. PATENT DOCUMENTS

| | | | | |
|---|---|---|---|---|
| 8,425,313 | B2 | 4/2013 | Nelson et al. | |
| 8,469,260 | B2 | 6/2013 | Lyons et al. | |
| 8,469,800 | B2 | 6/2013 | LeMay et al. | |
| 8,696,463 | B2 * | 4/2014 | Potts | A63F 3/00157 235/380 |
| 8,715,066 | B2 | 5/2014 | Prather et al. | |
| 8,968,075 | B2 | 3/2015 | Warner | |
| 8,969,642 | B2 | 3/2015 | Pelati et al. | |
| 8,979,643 | B2 | 3/2015 | Warner | |
| 8,979,644 | B2 | 3/2015 | Warner | |
| 9,058,620 | B1 | 6/2015 | Boyle et al. | |
| 9,129,314 | B1 | 9/2015 | Boyle et al. | |
| 9,196,123 | B2 | 11/2015 | Sanford et al. | |
| 2006/0025222 | A1 | 2/2006 | Sekine | |
| 2006/0046834 | A1 | 3/2006 | Sekine | |
| 2008/0268934 | A1 | 10/2008 | Mattice et al. | |
| 2012/0276851 | A1 | 11/2012 | Layne, IV et al. | |
| 2013/0017884 | A1 | 1/2013 | Price et al. | |
| 2013/0053136 | A1 | 2/2013 | LeMay et al. | |
| 2013/0065668 | A1 | 3/2013 | LeMay et al. | |
| 2013/0137509 | A1 | 5/2013 | Weber | |
| 2013/0137510 | A1 | 5/2013 | Weber | |
| 2013/0203489 | A1 | 8/2013 | Lyons | |
| 2015/0038211 | A1 * | 2/2015 | Santosh | G07F 17/3218 463/19 |
| 2015/0148120 | A1 | 5/2015 | Warner | |
| 2015/0187177 | A1 | 7/2015 | Warner et al. | |

OTHER PUBLICATIONS

"Boyd Gaming Smartphone Application" screenshot of YouTube video, download date: Jul. 2013, Uploaded to YouTube on Nov. 16, 2010, 1 page.

"Greektown Casino-Hotel Smartphone App Now Available on Windows® Phone 7." Download date: Jul. 2013, publication date: May 16, 2011, 2 pages.

"More Consumer Electronics to Incorporate NFC for Connectivity This Year." NFC Times, downloaded from web page: <http://nfctimes.com/report/more-consumer-electronics-incorporate-nfc-year-connectivity>, publication date: Jan. 14, 2013, 6 pages.

* cited by examiner

Mobile Device Screens

APP Downloaded to Mobile device

Mobile Device Screens

Player Successfully Logged In

Mobile Device Screens

Select "SCAN" to Identify Slot to Play

Player logged Into System

Data Table of Player Information

| Player Credentials | Players Unique Identifier | Comp Balance | Funds (Account) Balance |
|---|---|---|---|
| | | | |
| UserName /Password<br>Player Number / PIN<br>Device Id | 12345678 | | |
| :<br>: | 16273849 | | |
| UserName /Password<br>Player Number / PIN<br>Device Id | 98765432 | | |

Figure 17

Automated Prompt to perform funds transfer to Gaming machine

Messages and Social Networking

Game Settings

Transfer Settings

Favorite Settings

Ratings

USE OF MOBILE DEVICE AS A DIRECT INPUT/OUTPUT DEVICE FOR A PLAYER TRACKING SYSTEM FOR GAMING MACHINES

CROSS-REFERENCE TO RELATED APPLICATIONS

This application is a continuation of U.S. application No. 14/492,868 filed Sep. 22, 2014, the entire disclosure of which is incorporated by reference herein.

This application claims priority to U.S. Provisional Patent Application No. 61/881,757 filed Sep. 24, 2013, which is incorporated herein by reference.

BACKGROUND OF THE INVENTION

Conventional player tracking systems are used by casinos to monitor player activity on slot machines. These systems require the installation of several hardware and software components to each slot machine. These components are in addition to other hardware installed to facilitate slot machine accounting reporting, slot revenue analysis, slot event (alarm/error condition) tracking and/or to meet regulatory/internal auditing requirements.

Player tracking requires that the player be identified at the start of play and when play has been completed. Any slot activity in the interim can then be attributed to that specific player. All player tracking systems require a component that collects some portion of slot data. Player tracking systems have traditionally been additive to slot Accounting systems. Slot accounting can exist without player tracking components, but player tracking components cannot exist without slot accounting components.

The most basic function of a player tracking system is to identify the following for each session of the player at the slot machine:

i. What slot machine is being played ii. How much Coin-In and Coin-Out activity is generated iii. The number of games played iv. The amount of time spent on slot (elapsed time from start of session until the end of the session)

The capturing of activity is accomplished by interfacing to the existing slot accounting system. In nearly all cases, the slot accounting system interfaces to the slot machine using a communication protocol such as Slot Accounting System (SAS), Slot Data Systems (SDS) or the New South Wales (NSW) X-protocol.

One example of a player tracking system that is compatible with the SAS protocol is the SlotScanner™ Player Tracking module available from Advansys Solutions, which includes machine-mounted hardware and backend software.

FIGS. 1-2 show diagrams of current conventional hardware components for a conventional slot accounting system.

These components include those that are required to facilitate the collection of data for slot machine accounting, analysis, event tracking and/or to meet regulatory/internal auditing requirements.

i. Serial interface to Slot Machine SAS (Slot Accounting System) port—(allows bi-directional communication between the "Host" system and the slot machine)

ii. Slot machine controller unit—Depending on the system this can be one per slot machine or per several slot machines. These controllers have traditionally been designed to support player components from the list below.

iii. Communications system between controller and System server—This is done by TCP/IP, serial or some other method directly to a Central Server.

iv. Central server stores collected information as well as holds logic controlling how the information is collected and displayed.

FIGS. 3-4 show diagrams of current conventional additional components added to the FIG. 2 components to support conventional player tracking.

FIGS. 5-6 show details of player facing interfaces at each slot machine in a conventional slot accounting and player tracking system, which includes the following components:

Decorative/Mechanical Components i. Player panel designed to hold player facing components (must be customized to fit each manufacturers' game type (at least 100 types)

ii. Player panel overlays with artwork

Functional Components—All of these devices connect to and are dependant up on the slot accounting system. Information collected from or sent to these devices either comes from or is sent to a central server.

i. Display (can be simple "Text based" to "Full color graphics touch screen")

ii. Player facing card reader (usually mag-stripe reader)

iii. Keypad (or soft keys from touch screen display)

iv. Casino-issued player card—The player inserts the card into the card reader to identify the start and end of the player session at the slot machine.

Other items required to support player tracking:

i. Additional logic and storage capacity is required at the central server to enable Player Tracking ii. Ability to Issue and re-Print Player Cards a. Card Printers / Card Stock b. Staff

SUMMARY OF THE PRESENT INVENTION

Each slot machine is provided with a unique ID number that is user-accessible. The unique ID number may be related to or associated with the slot machine's existing unique ID number, which is typically not user-accessible.

Instead of the player tracking elements being installed on the slot machine, the slot machine is provided with a player accessible identification means so that when a player tracking system application (app) is opened on a player's mobile device, the player can input the unique ID number into the mobile device. The mobile device is a smartphone in the example discussed below.

The identification means on the slot machine may be passive or active. Passive examples include an ID tag such as a QR code or other form of 2-D bar code, as discussed in more detail below (to be scanned by smartphone app), a Bar code (to be scanned by smartphone app), or a user-readable number (to be read by user and typed into a field in the app). Active examples include proximity detection devices, such as an RFID transponder or a near-field communication (NFC) device. For an active embodiment, the smartphone is equipped with suitable detection devices. Many smartphones come with pre-installed NFC devices. Alternatively, the casino may lend the player a device to connect to their smartphone for providing the necessary device detection.

The active examples have the advantage of providing for a higher level of automatic player presence detection for minimizing fraud such as slot machine activity that is not being conducted by the player who is logged into and presumed to be operating the slot machine. However, additional technology can be used in the passive examples to provide similar functionality, such as using casino floor Wi-Fi signals or cellphone location methods (e.g., triangulation) to detect whether a player's smartphone is where it should be on the casino floor with respect to the slot machine that they are logged into.

In use, the app informs the player that the slot machine is now associated with their identity and all subsequent activity on the slot machine will be associated with the player until there is some form of manual or automated logout activity.

In sum, the present invention provides the combination of the following elements:

1. A gaming (e.g., slot) machine-mounted player-accessible ID number that can be automatically or manually entered into a mobile device app; and 2. A mobile device app that (i) accepts entry of the ID number, (ii) performs the player input actions associated with a conventional player tracking system, and (iii) replaces the functionality of a machine-mounted player tracking system. The player ID number which is conventionally encoded into a player loyalty card is either manually entered into the app or is pre-registered with the app when the app is downloaded into the mobile device.

The combination above allows smartphones via the app to become part of the casino's player tracking system.

The smartphone can alternatively be a tablet PC, such as an iPad, or any other mobile device that can download and execute applications (apps).

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown.

In the drawings:

FIG. 17 shows a data table of player information in accordance with one preferred embodiment of the present invention.

DETAILED DESCRIPTION OF THE INVENTION

Certain terminology is used herein for convenience only and is not to be taken as a limitation on the present invention.

Figure 1:
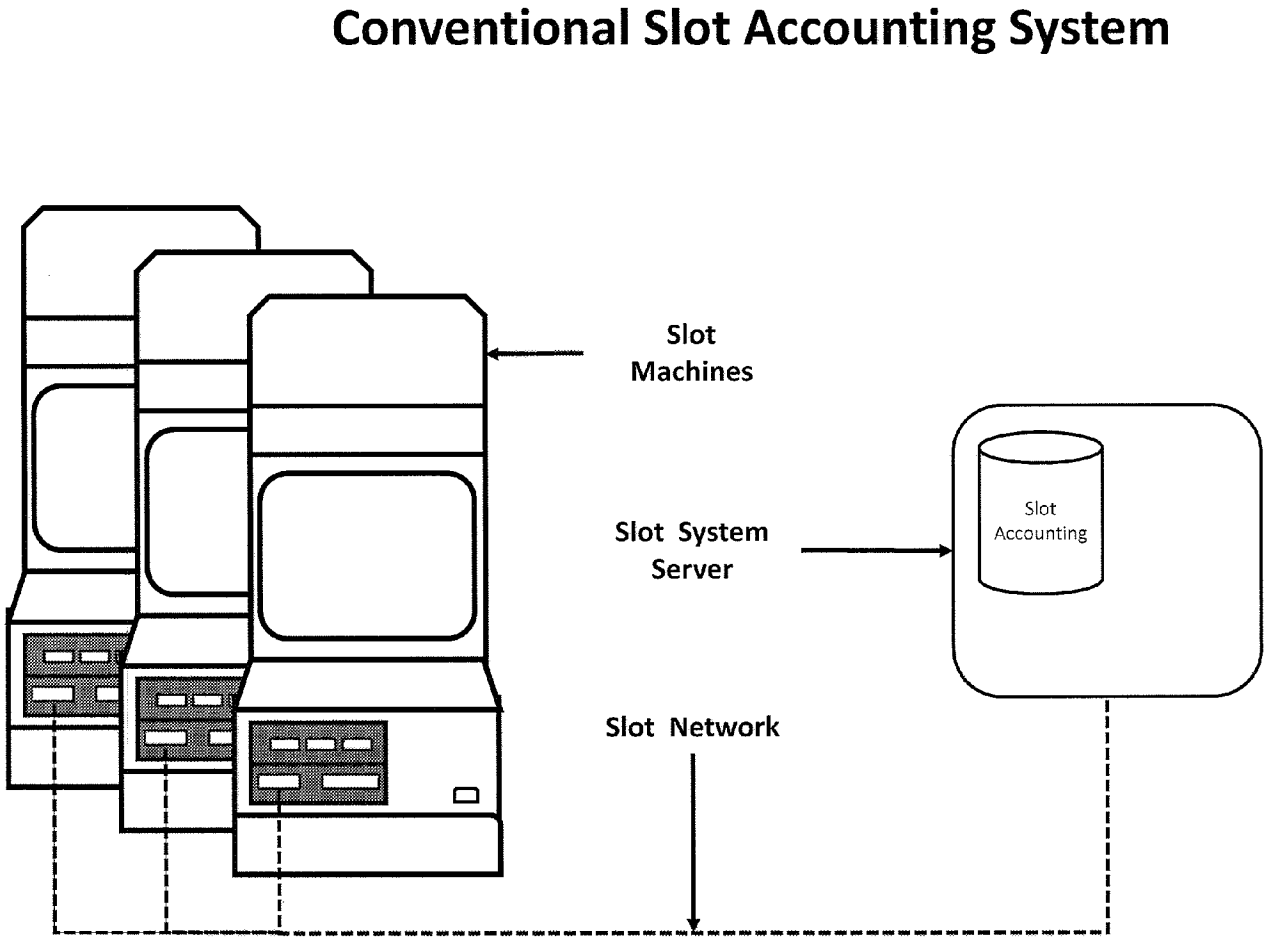
Figure 1 Prior Art
FIGS. 1-2 show diagrams of current conventional hardware components for a conventional slot accounting system.
Figure 2:
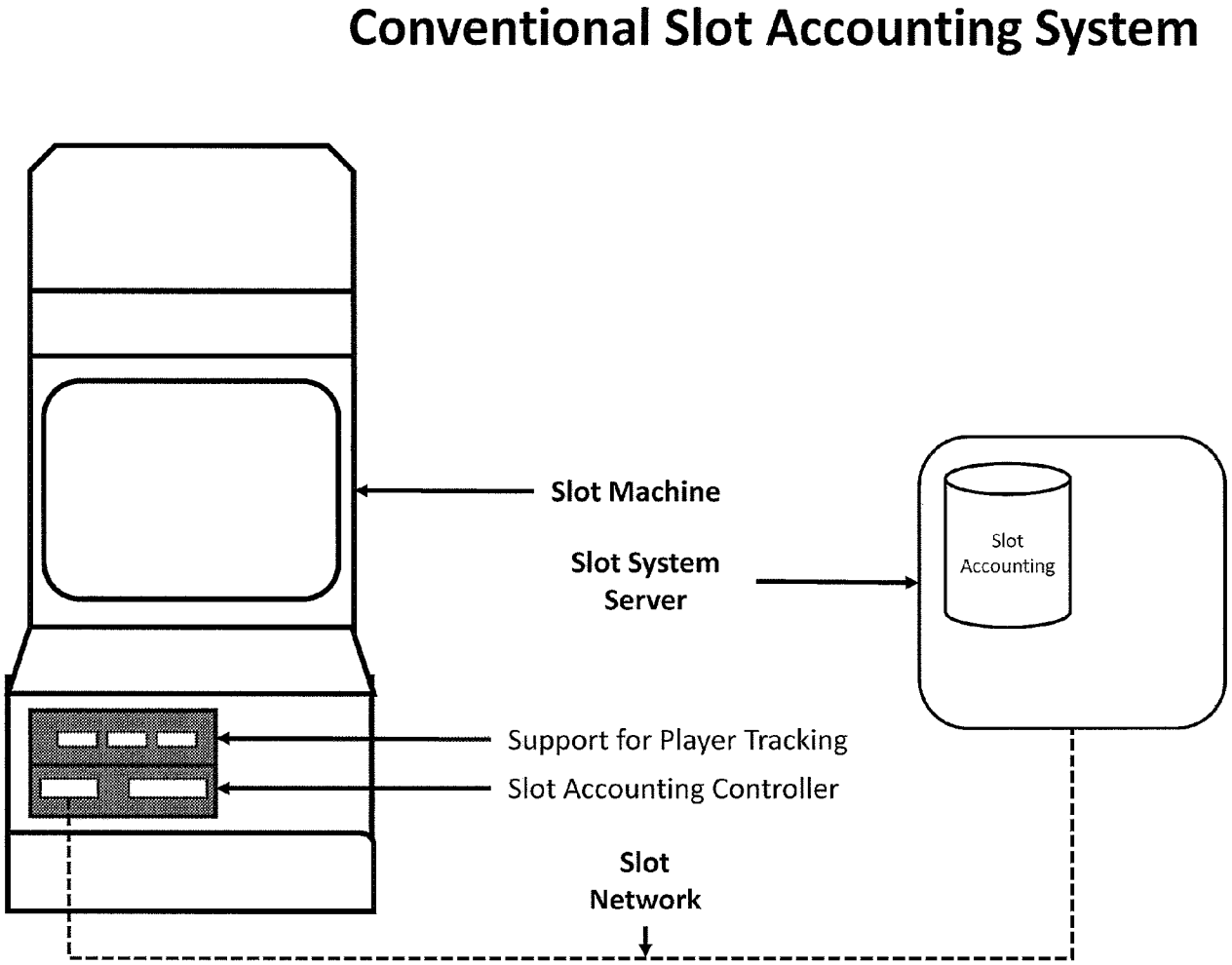
Figure 2 Prior Art
Figure 3:
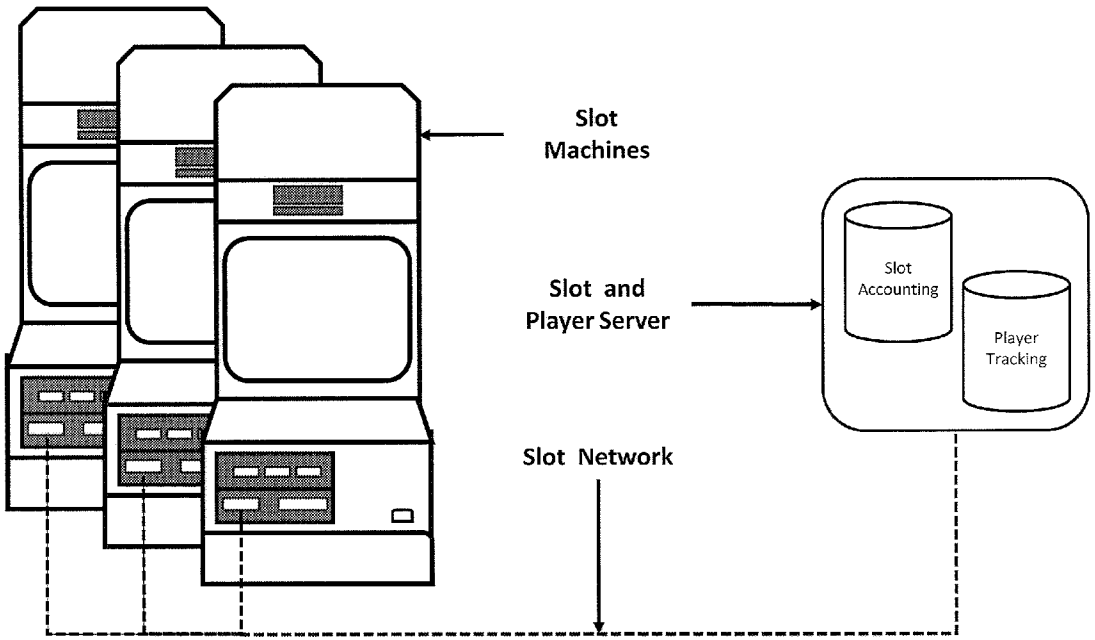
Figure 3 Prior Art
FIGS. 3-4 show diagrams of current conventional additional components added to the FIG. 2 components to support conventional player tracking.
Figure 4:
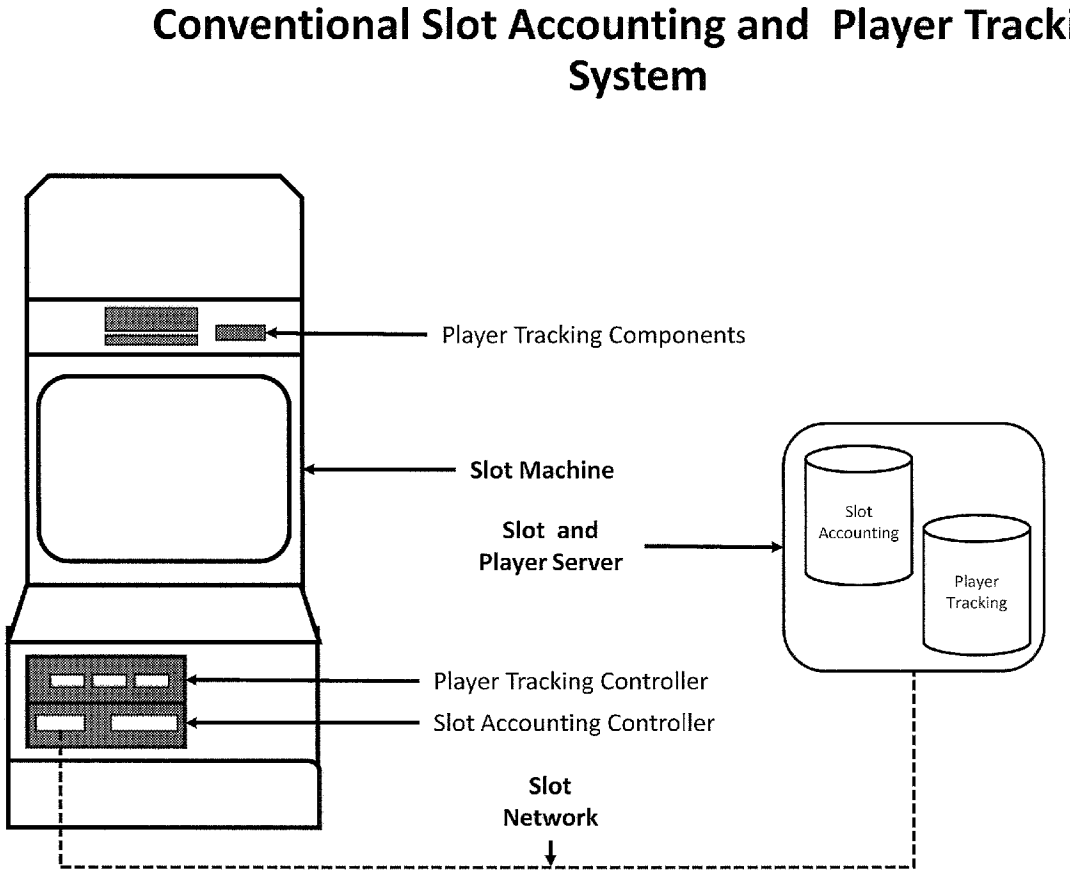
Figure 4 Prior Art
Figure 5:
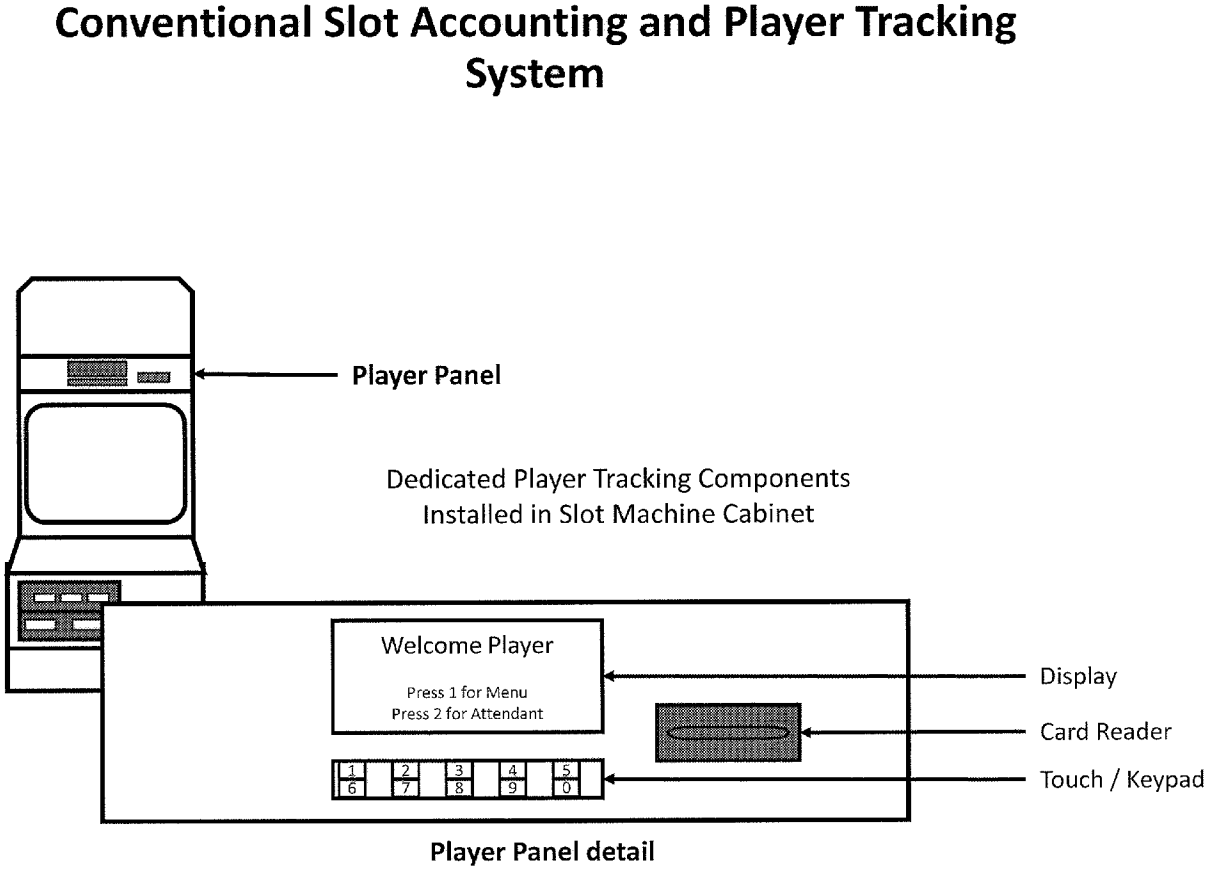
Figure 5 Prior Art
FIGS. 5-6 show details of player facing interfaces at each slot machine in a conventional slot accounting and player tracking system.
Figure 6:
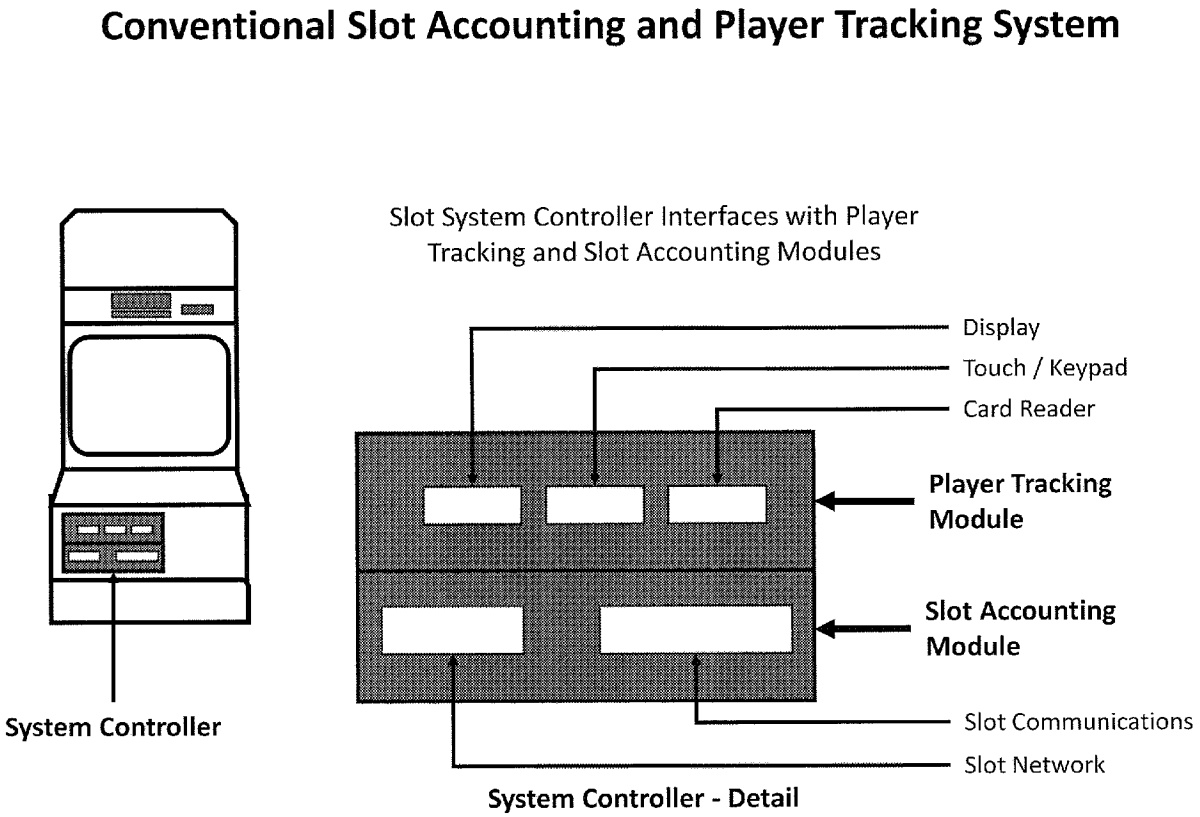
Figure 6 Prior Art
Figure 7:
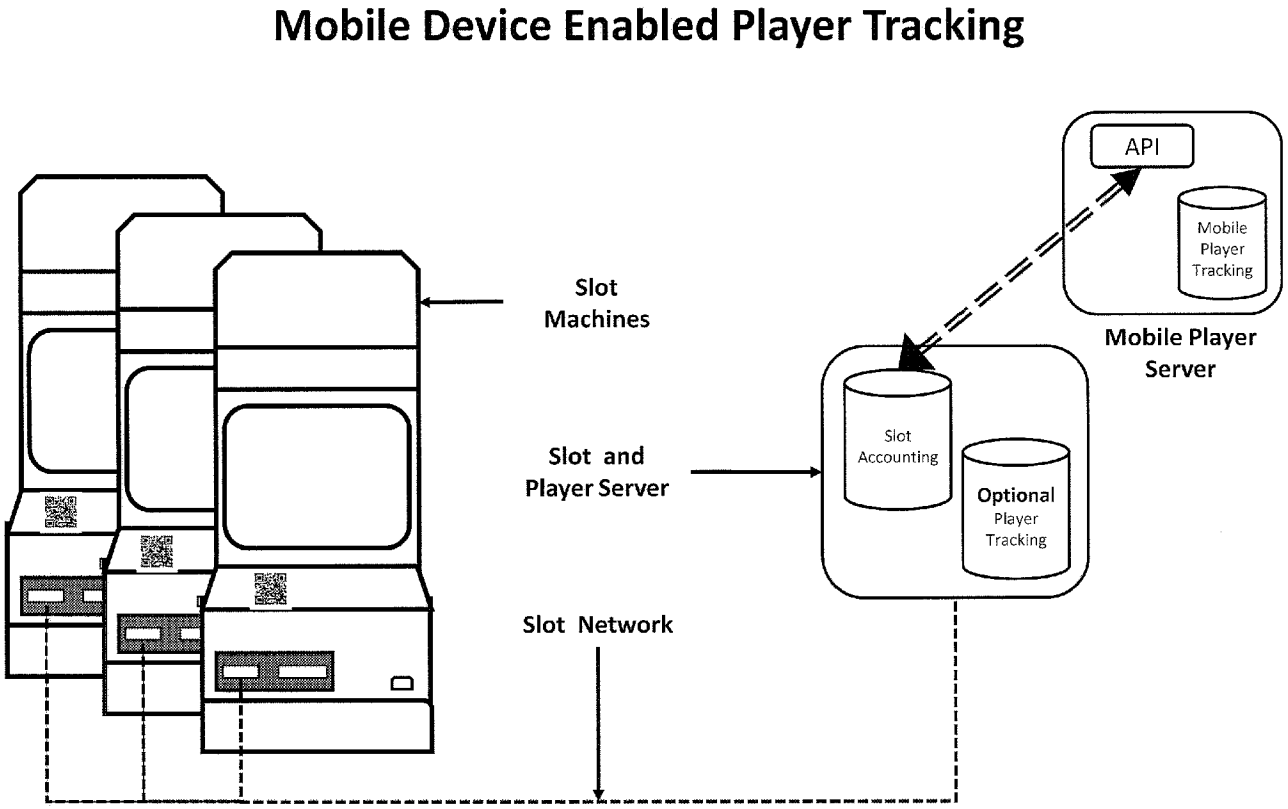
FIG. 7 shows a system in accordance with one preferred embodiment of the present invention.
Figure 8:
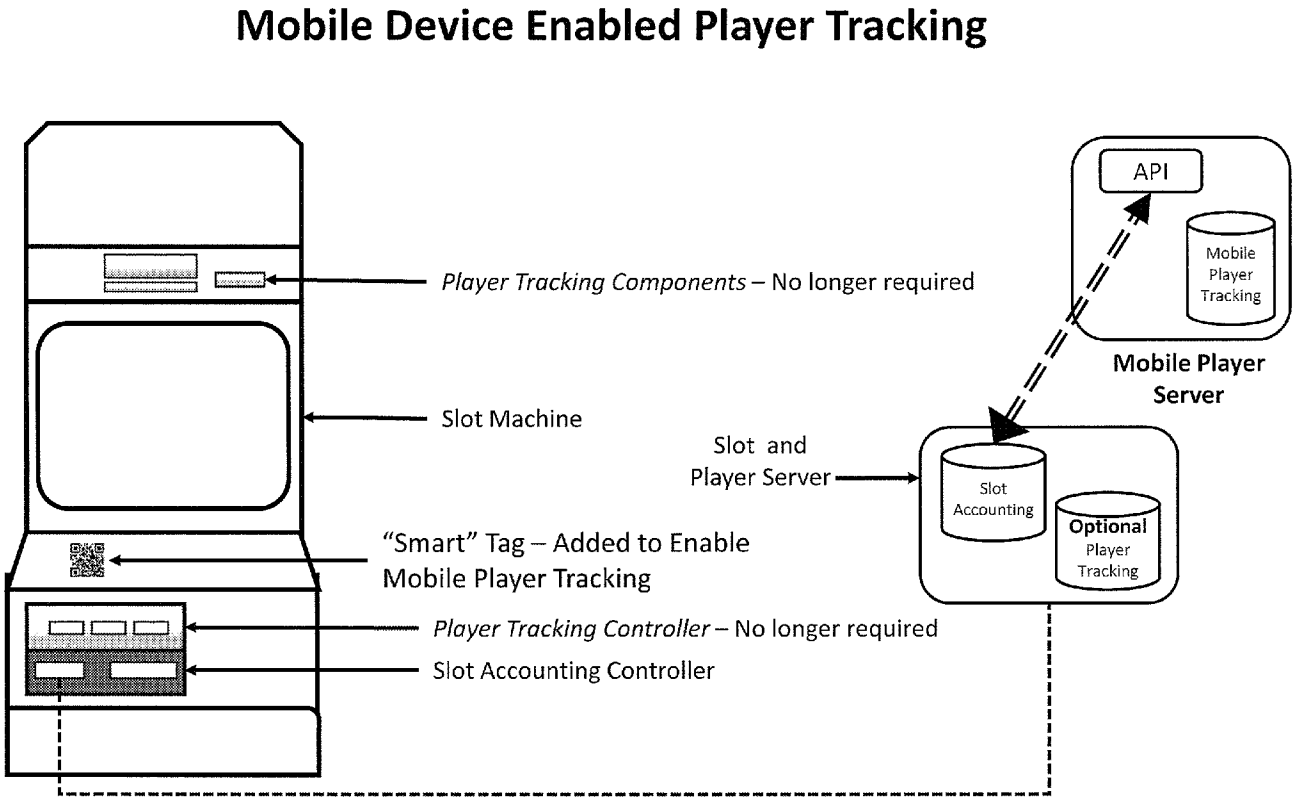
FIG. 8 labels system components in FIGS. 4-6 which are no longer needed in one preferred embodiment of the present invention.

FIG. 7 shows a system in accordance with one preferred embodiment of the present invention. FIG. 8 labels system components in FIGS. 4-6 which are no longer needed. The following components of FIGS. 4-6 are removed:

i. Player panel designed to hold player facing components (must be customized to fit each manufacturers' game type (at least 100 types).

ii. Player panel overlays with artwork.

iii. Display (can be simple "Text based" to "Full color graphics touch screen")

iv. Player facing card reader (usually mag-stripe reader)

v. Keypad (or soft keys from touch screen display)

vi. Casino Issued Player Card—The player inserts the card into the card reader to identify the Start and End of the Player session at the slot machine.

New Components Required by Casino for Present Invention Using Smartphone App:

i. Slot Machine mounted ID tag, such as a two-dimensional bar code, also referred to as a "two-dimensional code" or "2-D code." 2-D codes are patterns with data encoded therein. The encoded data may be text, a URI/URL or raw data. One form of a 2-D code is a matrix barcode (data matrix code) which consists of black and white cells or modules arranged in either a square or rectangular pattern. Another form of a 2-D code uses clusters of triangles, such as the Microsoft® Tag and the Microsoft High Capacity Color Barcode (HCCB). One commonly used 2-D matrix-type code is a QR code which consists of black modules arranged in a square pattern on a white background. QR is an abbreviation for "Quick Response."

ii. Optional: Casino supplied Wi-Fi system. Can use cellular network or blended Wi-Fi/cellular if needed.

iii. An interface to existing slot systems data stream. This could be anything from an API that allows for requesting and posting data to a pre-existing system, to direct access to an existing database, to providing a feed from our own installed system.

iv. Downloadable player facing app

In one preferred embodiment, the player connects to the casino Wi-Fi. A Wi-Fi access page provides a portal to casino offerings as well as the opportunity to download the basic player facing app.

The present system allows casinos that have only slot accounting to inexpensively upgrade to player tracking without having to invest in expensive proprietary hardware.

The present system allows casinos that do not even have slot accounting to inexpensively install player tracking with the addition of lower cost slot accounting system hardware (e.g., controller does not need to be designed to support player tracking components).

FIGS. 9-15 show user interface display screens associated with the mobile app that the player interacts with.

Figure 9:
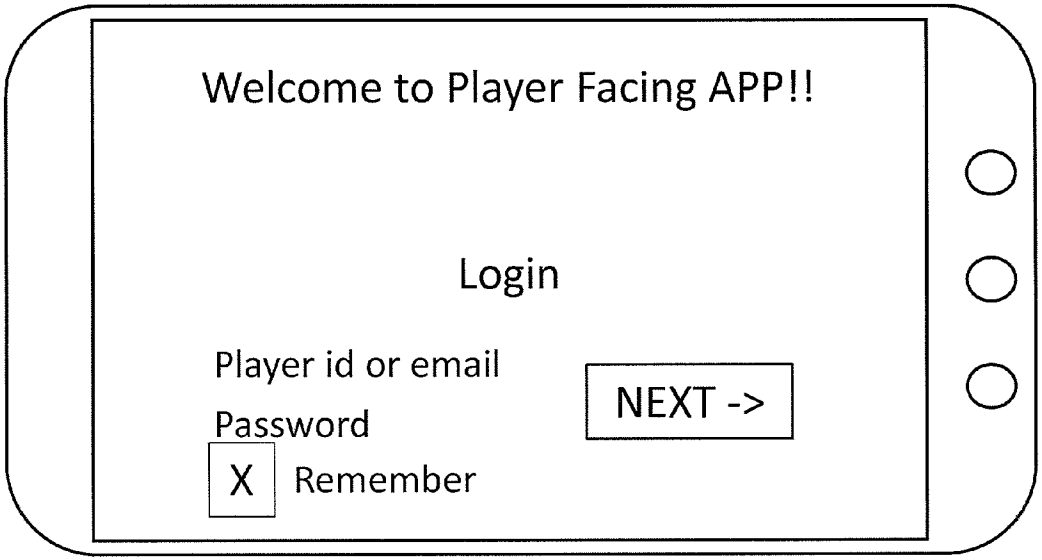
FIGS. 9-15 show user interface display screens associated with a mobile app that the player interacts with in accordance with one preferred embodiment of the present invention.

FIG. 9: Player Mobile device with App downloaded and ready for Player to enter login credentials.

Figure 10:
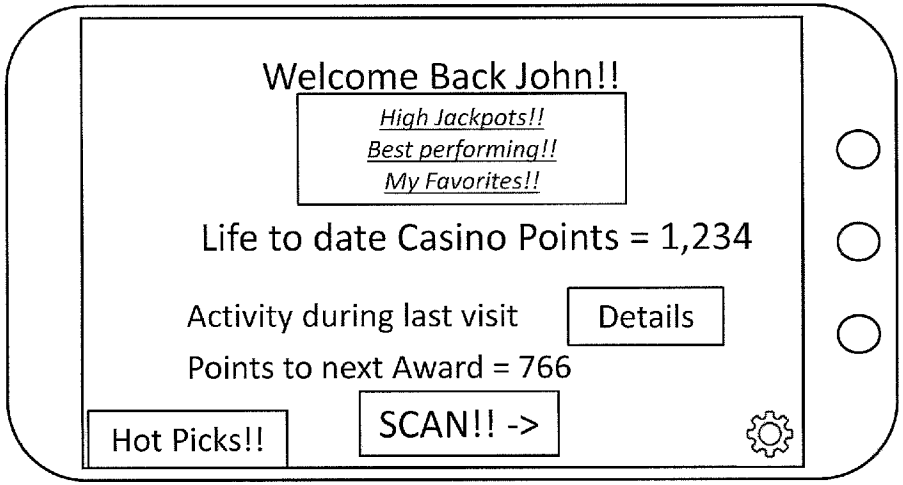

FIG. 10: Welcome screen after successful Player login.

Figure 11:
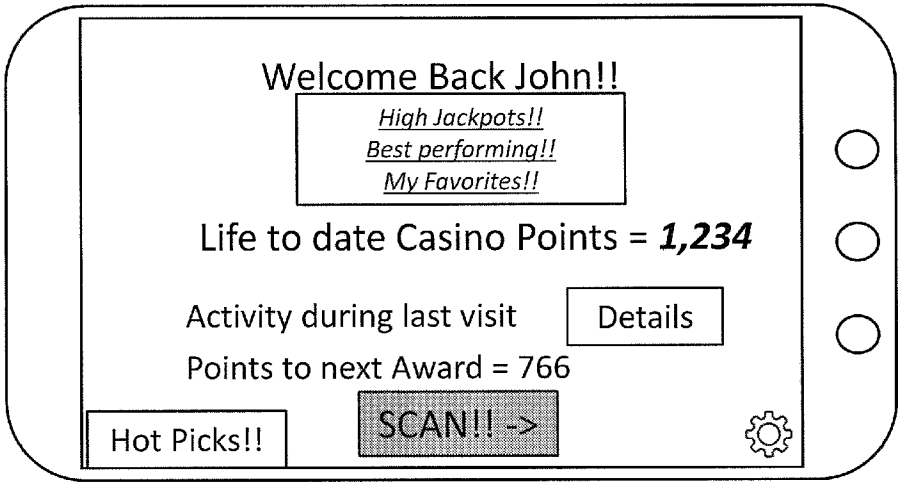

FIG. 11: Player selects the SCAN!! Function to scan the ID tag located on or near the slot machine.

Figure 12:
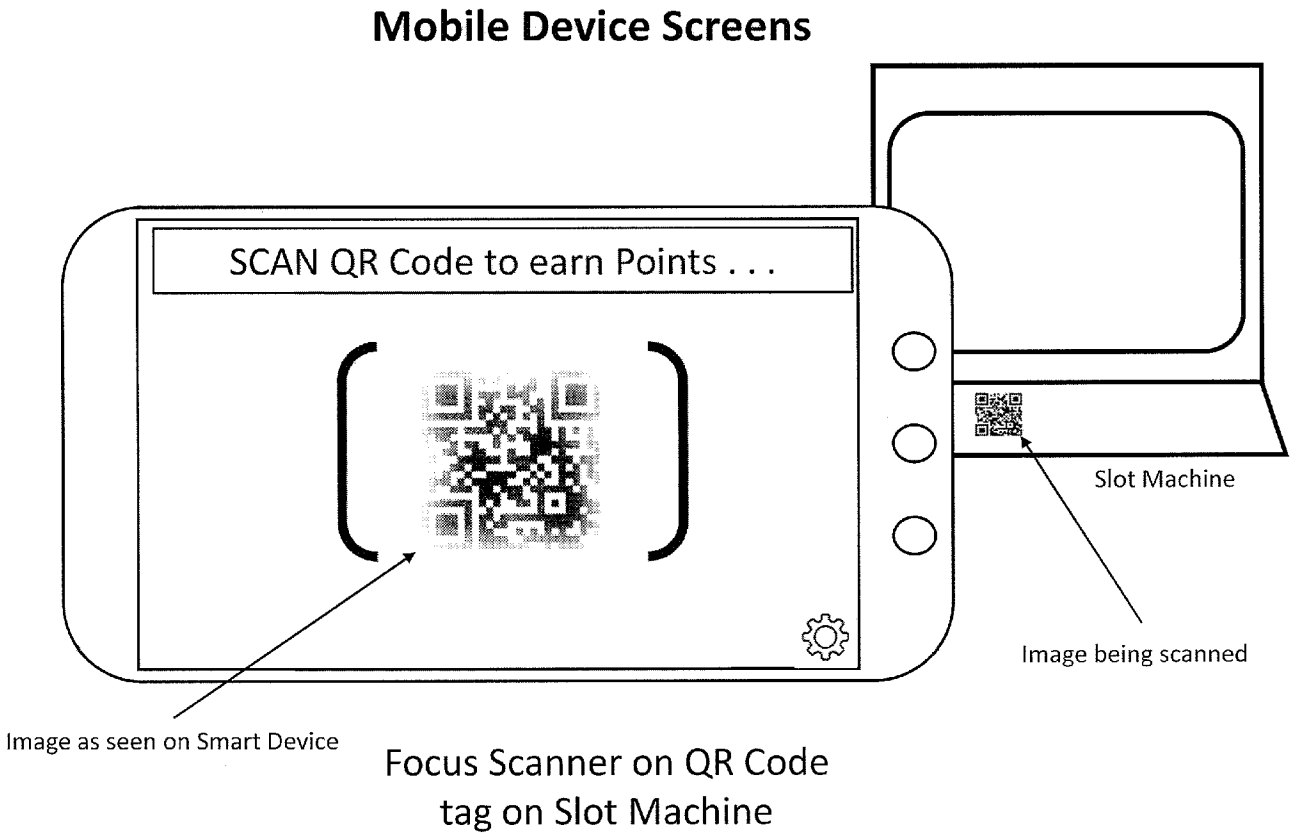

FIG. 12: Mobile device being pointed at ID tag in order to identify the associated slot machine.

Figure 13:
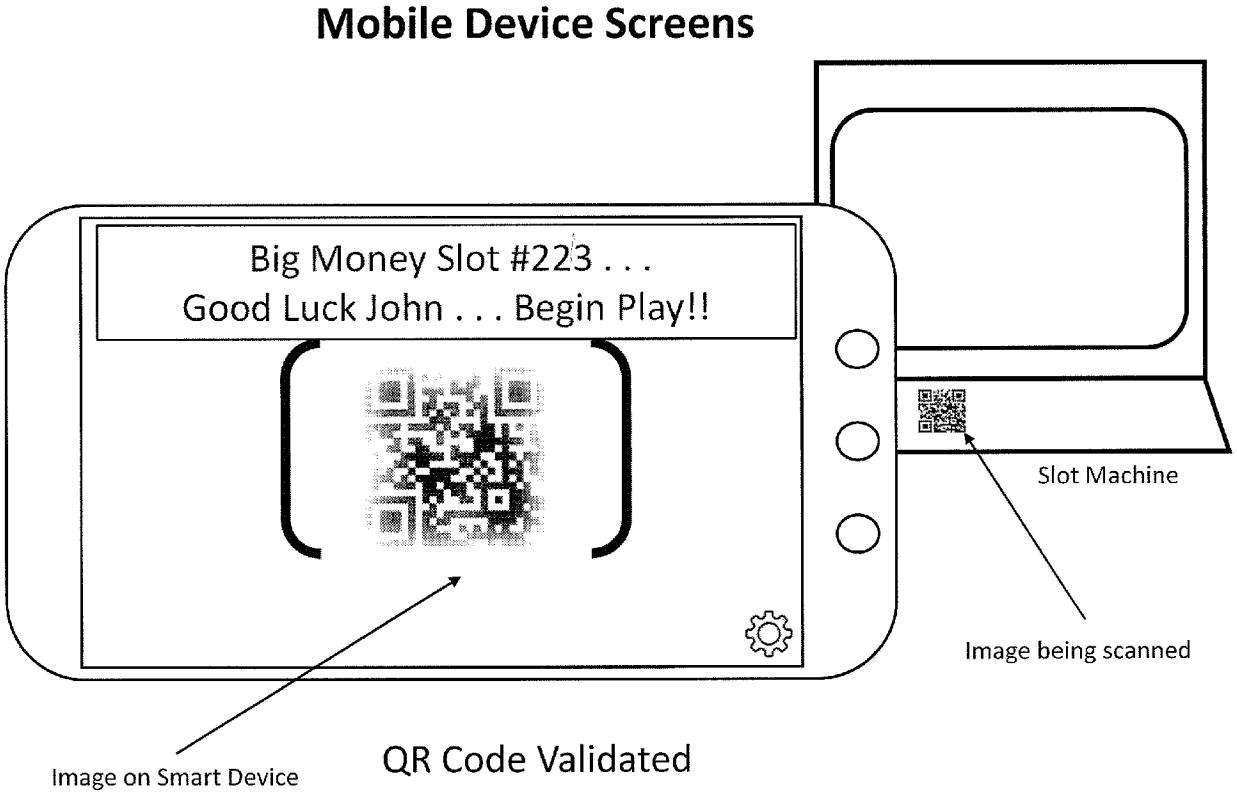

FIG. 13: ID tag is recognized and validated be the Mobile application server. The Player is notified of the recognition and prompted to begin Play.

Figure 14:
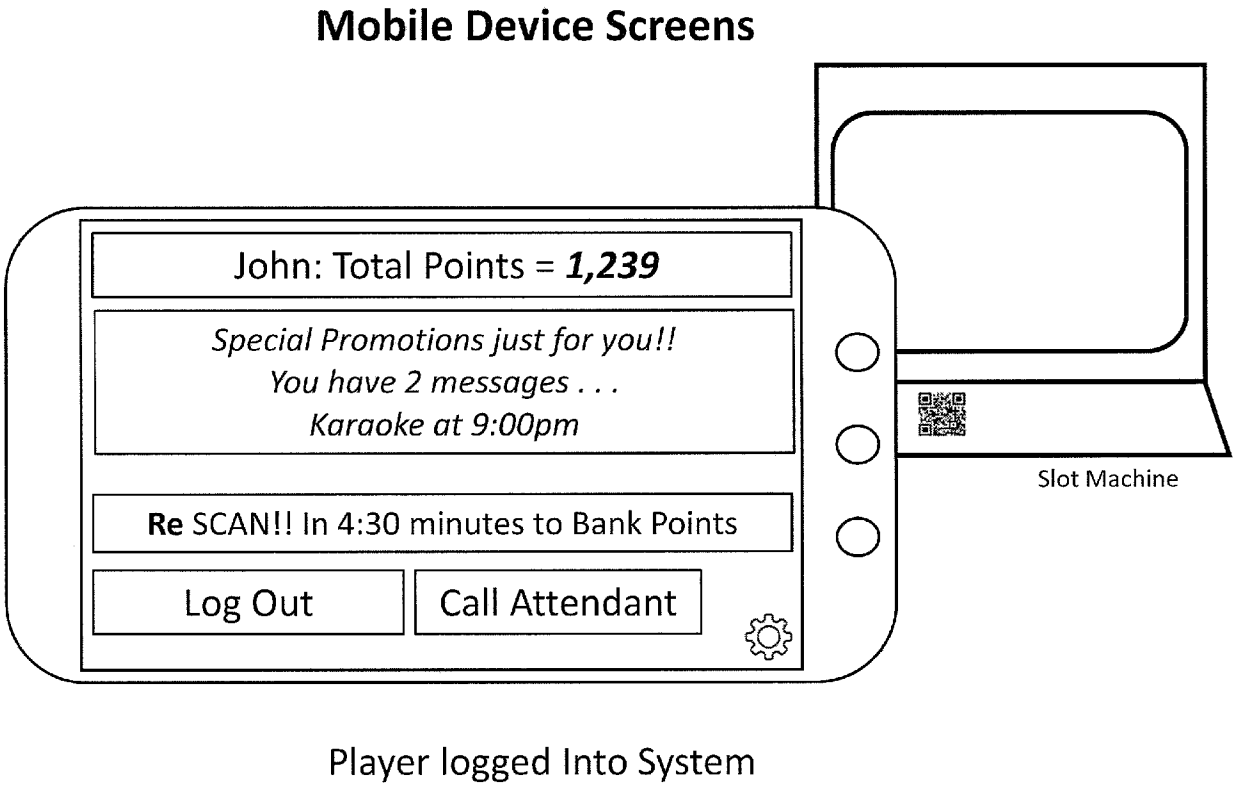

FIG. 14: As the Player generates activity on the slot machine, slot activity of the Slot Accounting System is monitored by the Mobile API. Player activity is updated on the Mobile application server as well as the Player Mobile device screen. The Player is also notified to re-scan the ID tag periodically in order to validate that they are still in proximity to the slot machine. Additional promotions and other Casino specific messages, as well as, third party advertising, social communication and Casino staff communications are provided on the Mobile device screen.

Figure 15:
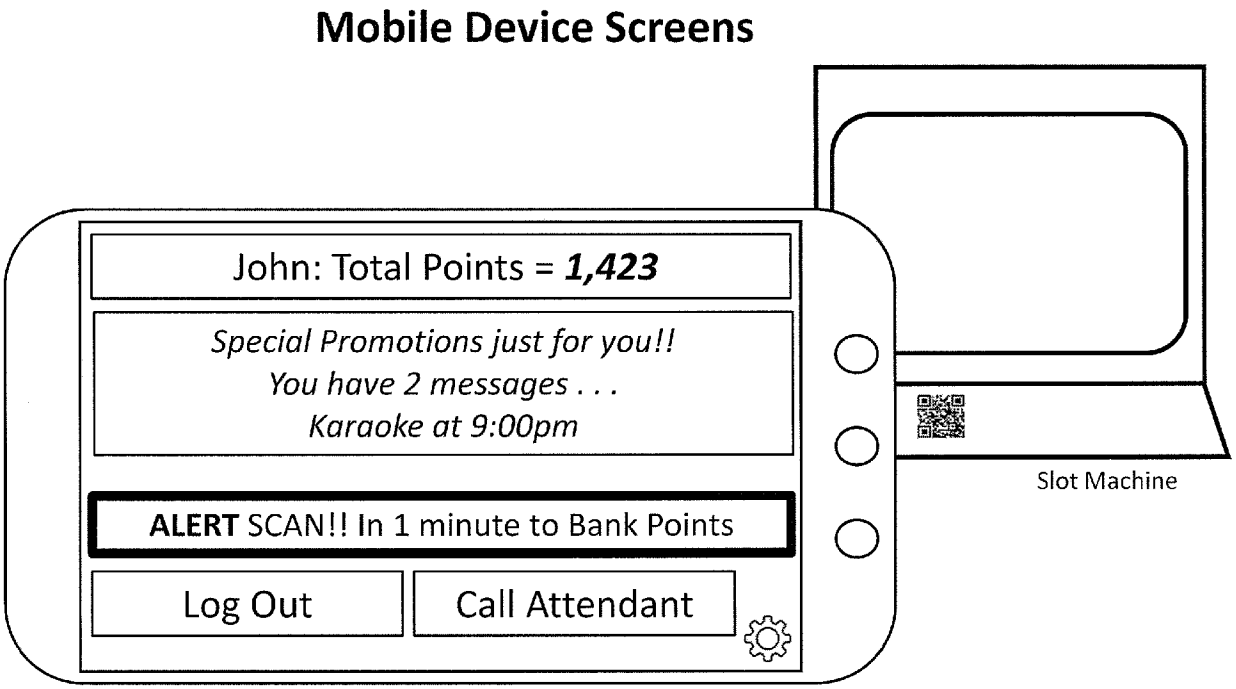

FIG. 15: Mobile application sends an alert to notify Player that ID tag must be re-scanned, or the system will cease to monitor and associate activity to the Player. If the Player does not re-scan the ID tag, they are automatically logged out of the session.

Figure 16:
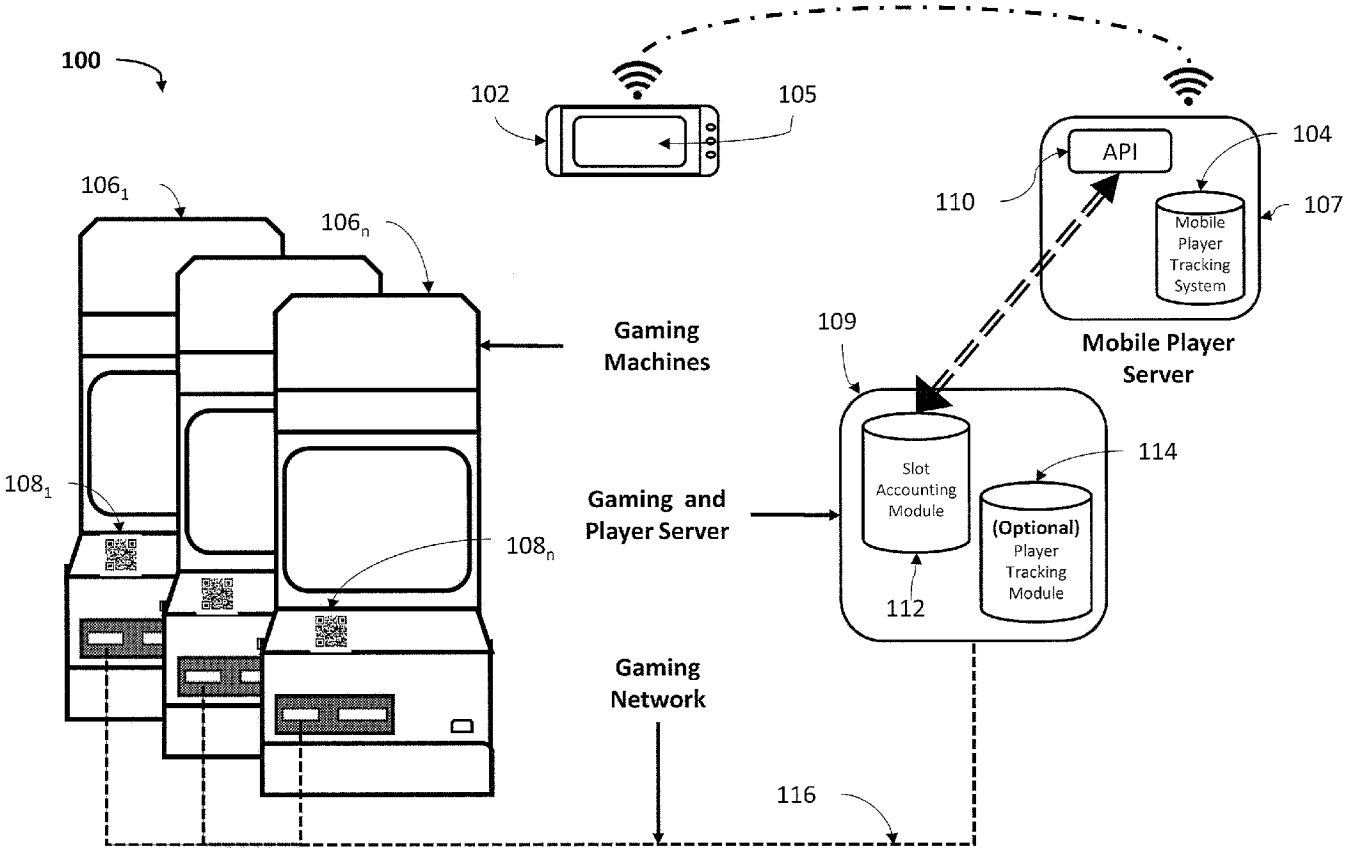
FIG. 16 shows a system in accordance with another preferred embodiment of the present invention.

FIG. 16 shows a detailed example of the components of a system 100 wherein a mobile device 102 is used as an input/output device for a mobile player tracking system 104 (also, referred to herein as a "player tracking system") for gaming machines $\mathbf{106}_1$-$\mathbf{106}_n$, some or all of which may be slot machines. A mobile app 105 executes within the mobile device 102. Each gaming machine 106 has a unique identifier $\mathbf{108}_1$-$\mathbf{108}_n$ and each player has a unique identifier that is associated with an account of the player.

The player tracking system 104 is located in a mobile player server 107 which is in communication with a gaming and player server 109 via an API 110 in the mobile player server 107. The gaming and player server 109 includes slot accounting module 112 and an optional player tracking module 114. The optional player tracking module 114 may include some or all of the data and/or functionality in the player tracking system 104. Alternatively, the player tracking module 114 may perform some of the functions of the player tracking system 104 in which case it becomes part of the player tracking module 114. The gaming machines $\mathbf{106}_1$-$\mathbf{106}_n$ are connected to the gaming and player server via a gaming network 116. The mobile device 102 communicates wirelessly with the mobile player server 107 via conventional wireless means, such as a Wi-Fi (local area wireless technology) or cellular technology, using either an internal or external network.

To initiate the process, player credentials are electronically communicated, via the mobile device 102, directly to the player tracking system 104. Each player credential is associated with a player's unique identifier that is maintained by the player tracking system. There may be more than one player credential for each player's unique identifier, thereby allowing a player to log into the player tracking system 104 in more than one way.

FIG. 17 shows a sample data table located in the player tracking system 104 for maintaining the player's credentials and unique identifier, as well as other player information, such as the player's comp balance and the player's fund (account) balance. The other player information may be in the same or different table as the player's credentials and unique identifier. The player's credentials may include a unique username/password combination, a unique player number/PIN combination or a device ID. In one embodiment, the device ID may be set as a default login credential, and if that fails, the player may be prompted to enter player credentials via the mobile app 105.

Electronic devices such as personal computers and mobile devices (e.g., smartphones, tablets) are typically assigned a unique device identifier, often referred to as a "device ID" or a "UDID." Preferably, the device ID is automatically detected so the user would not need to enter a password or PIN if the device ID was used as the credential. However, for additional security, a password or PIN may be requested to be entered after the unique ID is detected and verified as being associated with a player's unique identifier.

If the player credentials are properly matched up, the player is logged into the player tracking system 106.

The gaming machine 106 that the player wishes to play is then electronically communicated directly to the player tracking system 104 using the mobile device 102. As discussed above, this may occur in numerous ways, such as by scanning the machine's unique identifier 108 using the mobile device 102 as shown in FIGS. 12 and 13, entering the gaming machine number into the mobile app 105, or by passive means such as by associating the location of the player with the location of the gaming machine 106. Based on the information that has now been provided to the player tracking system 104, and prior to initiation of game play on a gaming machine 106, the player tracking system 104 associates the unique identifier of a player with the unique identifier of a gaming machine 106 that the player wishes to play. A play session is now initiated at the gaming machine 106 and game play at the gaming machine 106 is associated with the account of the player. Activity from the play session is captured by the player tracking system 104.

As discussed above, player credentials are electronically communicated, via the mobile device 102, directly to the player tracking system 104, and the gaming machine 106 that the player wishes to play is electronically communicated directly to the player tracking system 104 using the mobile device 102. This "direct" communication is depicted in FIG. 16 by the dashed line that extends between the mobile signals associated with the mobile device 102 and the mobile player server 107 which hosts the mobile player tracking system 104. "Direct" communication, as used herein, means that communication does not pass through, or require use of, any of the gaming machines 106 or the associated gaming network 116. Prior art methods for allowing mobile devices to work with gaming machines typically require that the mobile device communicate directly with the gaming machine and its associated network in order to convey information to and from a player tracking system. In this manner, the mobile device functions as a mere extension of the capabilities of the gaming machine. In contrast to these prior art methods, the direct communication described herein provides a new paradigm for the gaming experience wherein the mobile device acts independently from the gaming machine, while still providing all of the functionality of a conventional gaming machine, as well as enhanced functionality, some of which is described in more detail below.

Various information is displayed on a display screen of the mobile device 102 during the play session, including data regarding the player that is maintained in the player tracking system 104, such as the player's present balance of comp points. This information is electronically communicated from the player tracking system "directly" to the mobile device during game play, again, without passing through, or requiring the use of, any of the gaming machines 106 or the associated gaming network 116.

The mobile app 105 provides "real time" information directly from the player tracking system. "Real time," as used herein, means that whatever information has been posted to the player tracking system becomes immediately available to the mobile app 105.

As is well-known in the art, a gaming machine 106 has a credit meter and the funds in the account of the player are movable to and from the balance of the credit meter during a play session. In a conventional gaming machine, this is performed by using the dedicated player tracking components which are physically mounted into the gaming machine 106. In one preferred embodiment of the present invention, funds in the account of the player may be moved to the balance of the credit meter during the play session by making electronic requests via the mobile app 105 on the mobile device 102. Similar requests may be made to move funds from the balance of the credit meter to the account of the player during or at the end of the play session.

FIGS. 18-25 show user interface display screens associated with a mobile app 105 that the player interacts with in accordance with the system 100 of FIG. 16.

Figure 18:
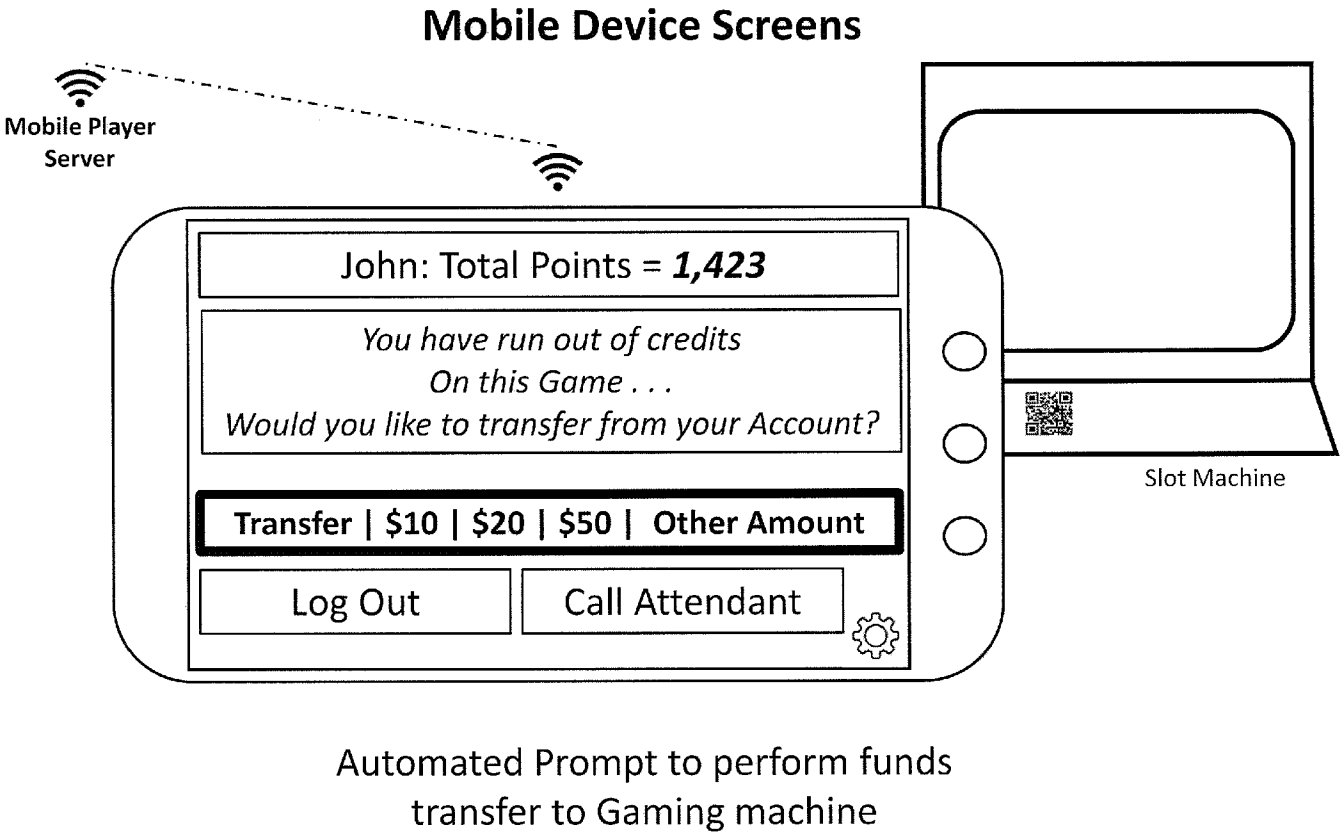
FIGS. 18-24 show user interface display screens associated with a mobile app that the player interacts with in accordance with the system of FIG. 16.
Figure 19:
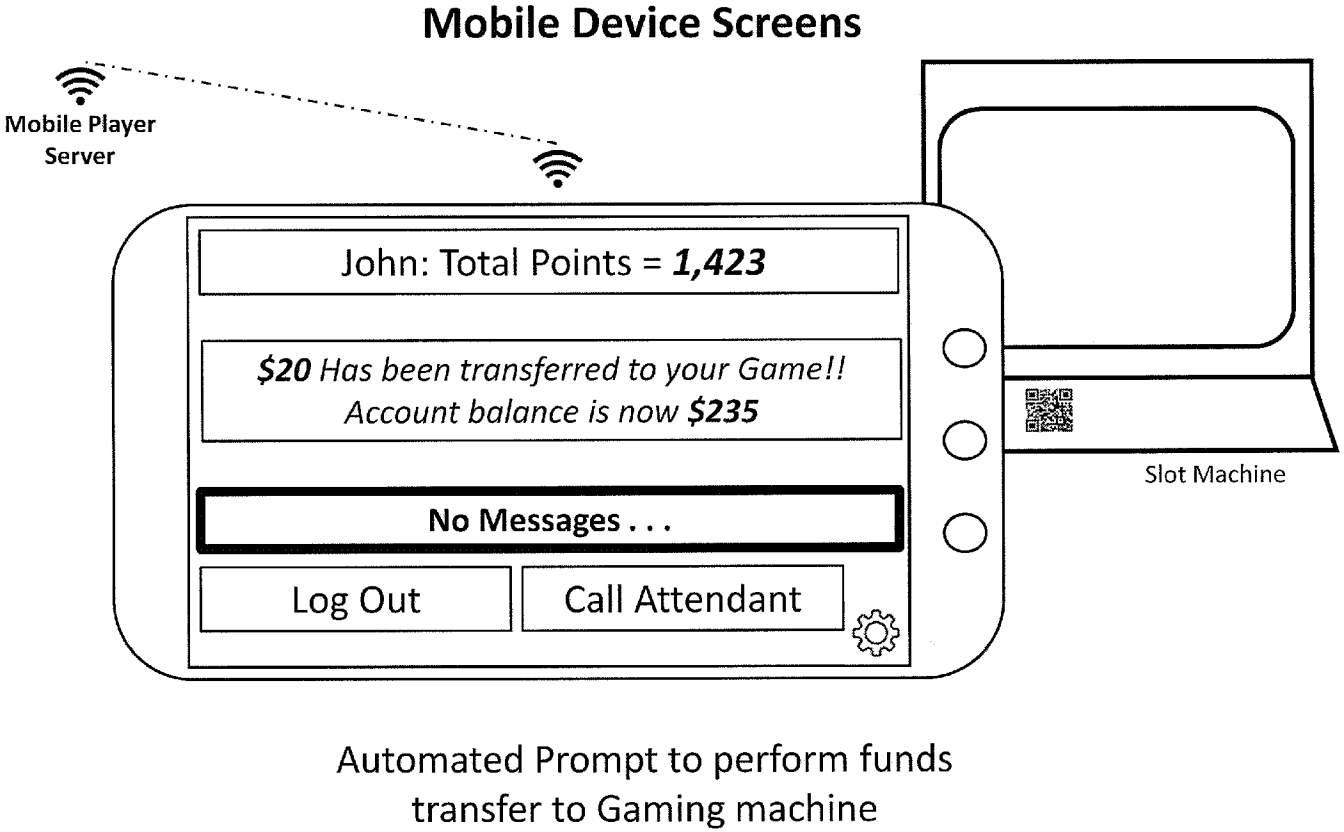

FIGS. 18 and 19 show automated prompts to perform a funds transfer when a gaming machine 106 runs out of credits.

Figure 20:
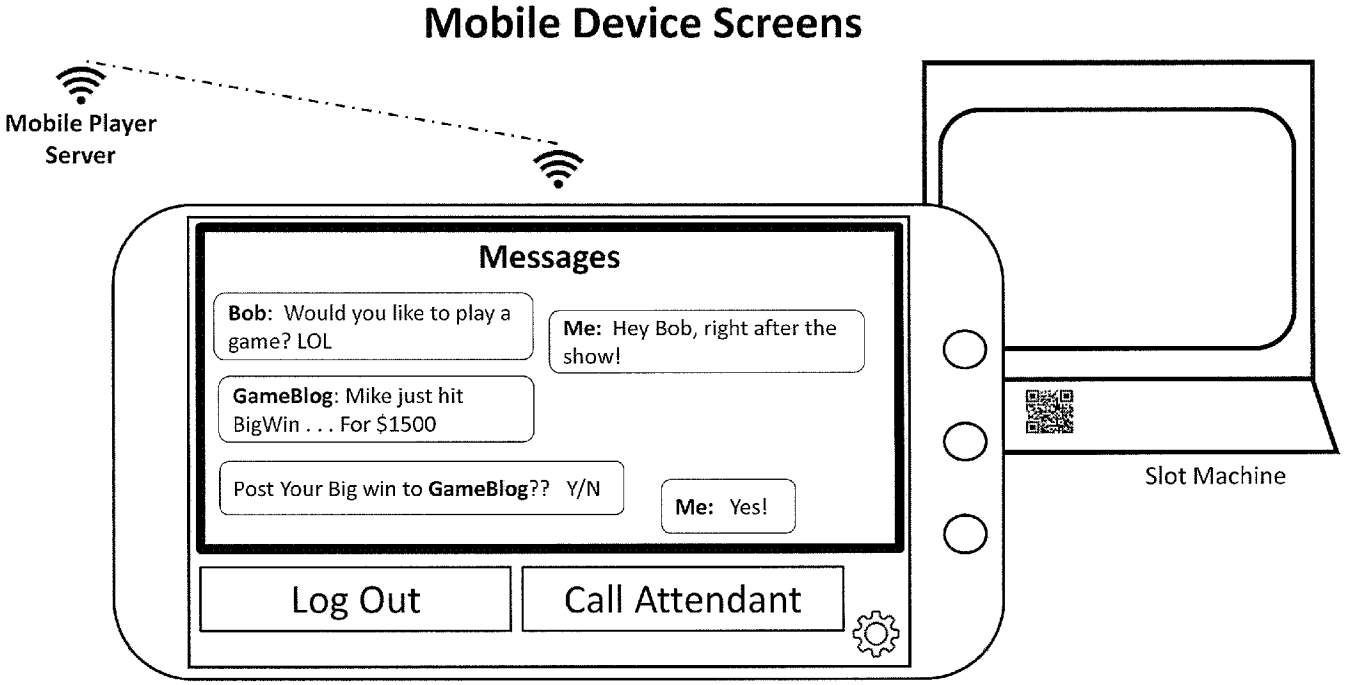

FIG. 20 shows an example of social networking-type messaging.

Figure 21:
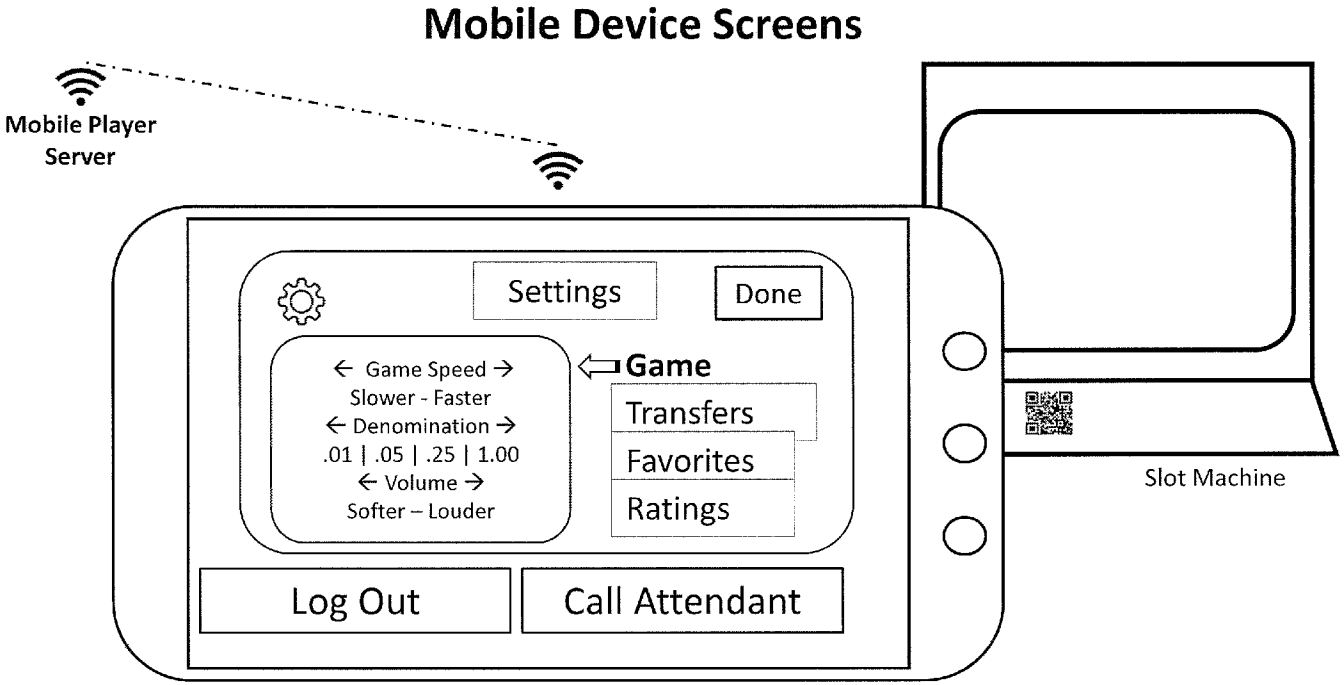

FIG. 21 shows how game settings may be adjusted via the mobile app 105.

Figure 22:
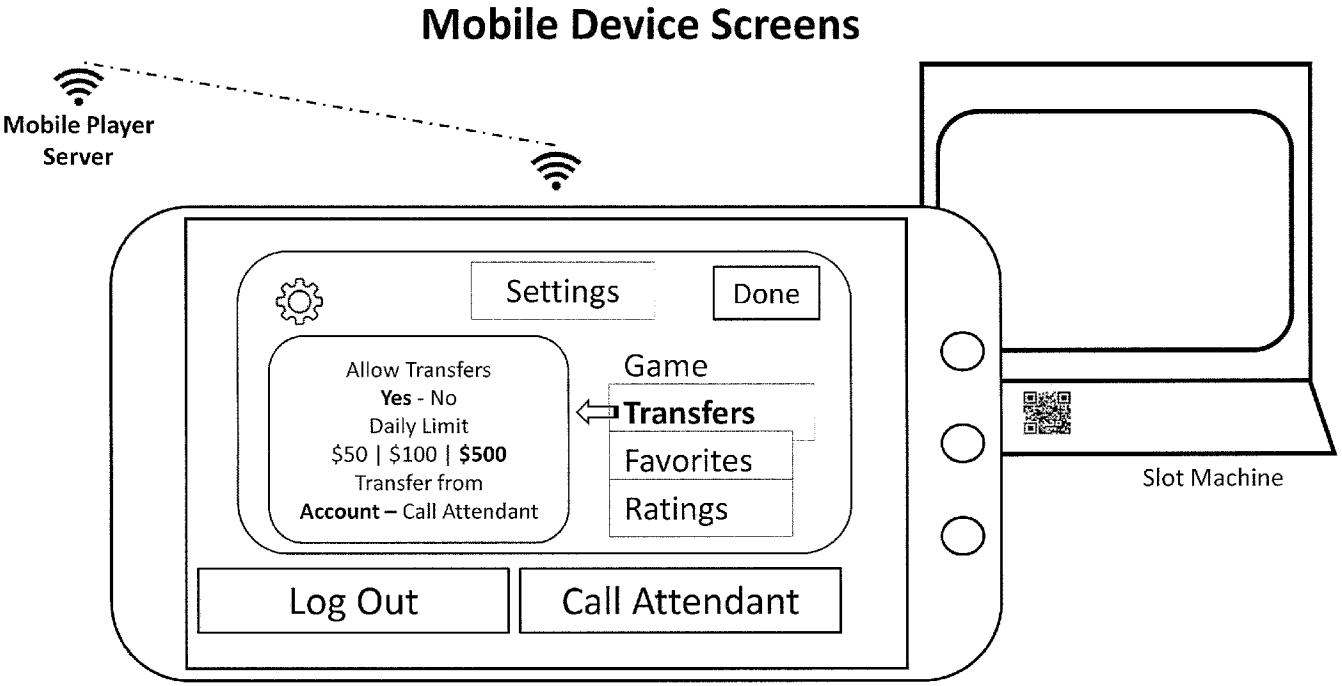

FIG. 22 shows how funds transfer settings may be adjusted via the mobile app 105.

Figure 23:
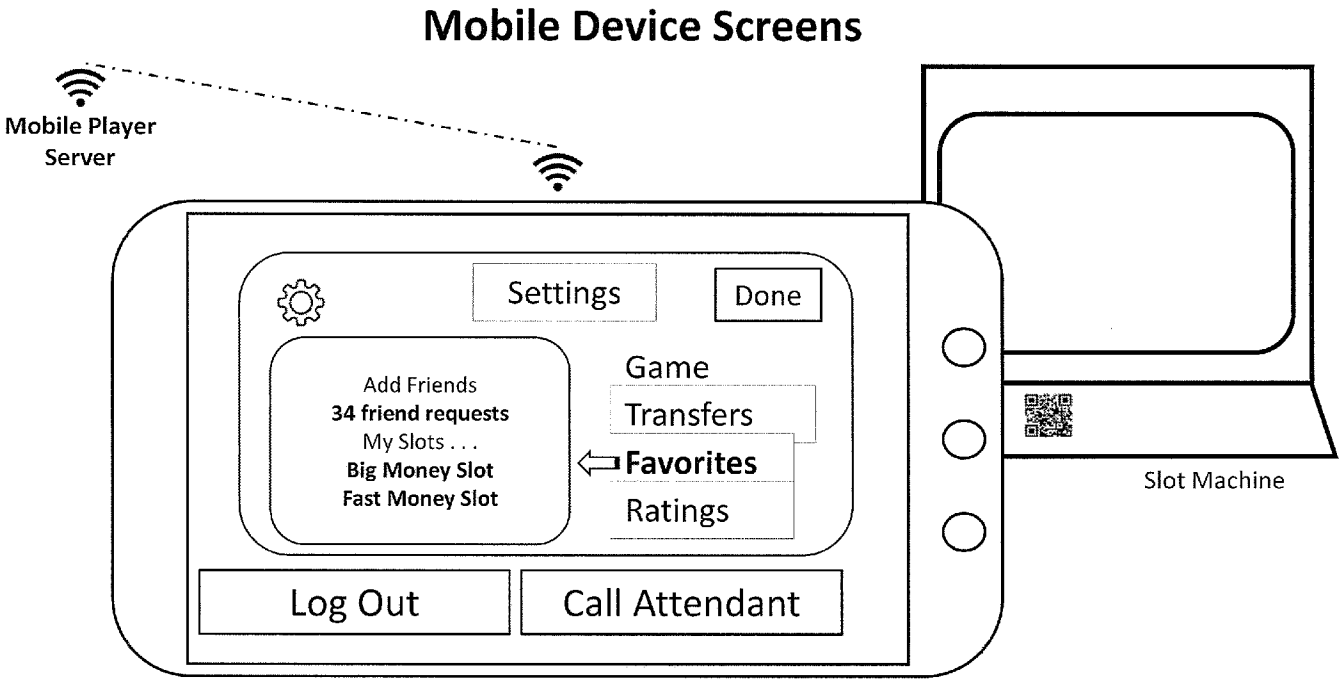

FIG. 23 shows how favorite settings may be adjusted via the mobile app 105.

Figure 24:
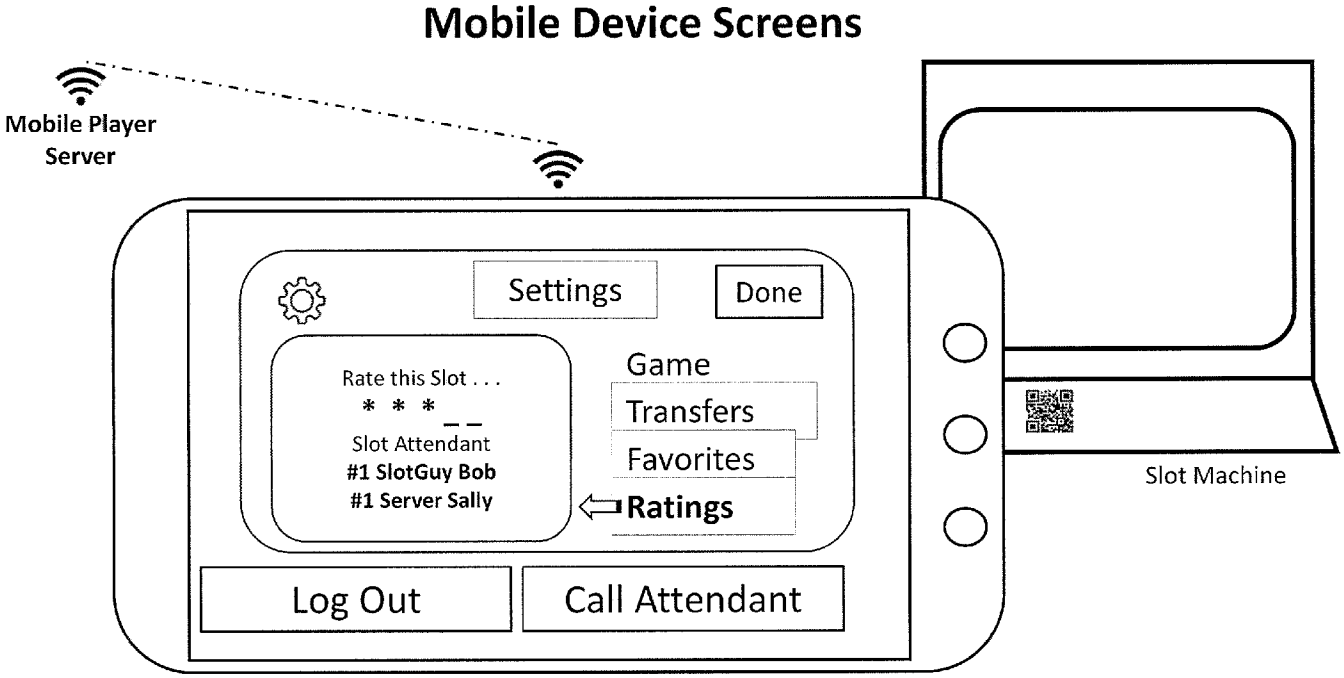

FIG. 24 shows how gaming machines can be rated via the mobile app 105.

ADDITIONAL CONSIDERATIONS/ALTERNATIVE EMBODIMENTS

1. Use of Mobile Device 102 for Adding Funds to Player's Account Balance

The mobile app 105 may also be used to add funds to the balance of the player's account via a credit card-type payment process. Once the player's account balance has been updated, the new funds in the account balance become available to be moved to a credit meter of a gaming machine 106 that the player wishes to play.

In the gaming industry, and particular in the casino industry, player tracking systems are tightly controlled and access by players is typically only permitted via dedicated hardware mounted into the gaming machines 106 (e.g., slot machines). It is therefore counterintuitive to allow players to interact with a player tracking system via a device that is in the control of the player, here, a mobile app 105 executing on the player's mobile device 102, such as a smartphone or the like.

2. Rotating QR Codes

In an alternative embodiment, the QR code may take the form of a virtual QR code display, instead of a printed medium (e.g., sticker). The display may have rotating (constantly changing) predefined or predetermined values. The displayed values are maintained in a remote server (not shown) that is in communication with the player tracking system 104. The remote server stores a table that associates the predefined or predetermined values for the QR codes with the respective gaming machines $\mathbf{106}_1$-$\mathbf{106}_n$.

One advantage of this feature is that it allows for the unique identification of the gaming machine 106 at a specific point of time. In this manner, the gaming establishment will know with more certainty who is actually playing a particular gaming machine 106 so that gaming activity can be properly associated with the player. A static QR code is prone to be fraudulently recorded/reprinted and then electronically rescanned from a remote location by a person who is not playing the gaming machine 106, thereby associating gaming activity with the wrong person.

3. Social Networking

A mobile player tracking feature allows for additional interaction between players and between players and the staff/marketing at the gaming establishment (e.g., casino). Players can now, for instance, reach out and share information with friends and family regarding goals they have reached, prizes won, favorable ratings of staff and/or venues at a gaming establishment, or favorable ratings of particular gaming machines 106. See, for example, FIG. 24.

4. Remote Control

The mobile app 105 may be used as a remote control to perform functions such as changing the total amount bet (e.g., 1 credit to 3 credits), denomination of each credit (e.g., 0.01 per credit to 0.25 per credit), or the number of lines on a slot machine (gaming machine 108). Other functions may include changing game speed or volume. This may be implemented on the display of the mobile device 102 using a virtual image of slot machine with touch regions that perform such functionality, or by using discrete buttons that provide such functionality without the virtual image. See, for example, FIG. 21.

5. Simultaneous Play Sessions on Multiple Gaming Machines

The player tracking system 104 allows the mobile device 102 to initiate play sessions at more than one gaming machine 106 at a time. For example, the mobile device 102 may initiate play sessions at three adjacent gaming machines 106. During the play sessions, the activity from the different gaming machines are associated with the same player account, namely, the account associated with the mobile device 102. This feature is made possible due to the "direct" communication that occurs between the mobile device 102 and the player tracking system 104. In prior art methods wherein the mobile device communicates directly with the gaming machine and its associated network in order to convey information to and from a player tracking system, the mobile device would typically need to log out of one gaming machine and then log into another gaming machine since it would typically be able to communication with only one device at a time. In the present invention, the mobile device 102 also communicates with only one device at a time, namely, the mobile player server 107 which hosts the player tracking system 104, but through this one communication path, the player may simultaneously log into a plurality of gaming machines 106.

6. Browser-Based Application and Mobile Instant Messaging

The embodiment disclosed above is implemented via a mobile app. In one alternative embodiment, the application associated with the mobile app executes in a browser (i.e., a browser-based application) on the mobile device 102, instead of executing within a mobile app. In embodiments wherein mobility is not a necessity, the application may execute in a browser at a computer or electronic device other than the mobile device 102, such as a computer or electronic device that is remotely located with respect to the gaming machines 106.

In another embodiment, the communications between the mobile device 102 and the mobile player server 107 may occur via mobile instant messaging (MIM), instead of via a mobile app executing on the mobile device 102. If a computer or electronic device other than the mobile device 102 is used, instant messaging (IM) via the computer or electronic device may be used for the communications.

7. Server-Based Gaming

The gaming machines 106 may be server-based gaming machines (SBG machines) or they may be conventional gaming machines wherein game machine elements such the game logic and the random number generator are physically located in the gaming machine 106.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A method of using a mobile device as an input/output device for a player tracking system for gaming machines, each gaming machine having a unique identifier, each player having a unique identifier that is associated with an account of the player, the mobile device including an application, the method comprising:

(a) electronically communicating player credentials, via the mobile device, directly to the player tracking system, wherein each player credential is associated with a player's unique identifier that is maintained by the player tracking system;

(b) electronically communicating directly to the player tracking system, using the mobile device, a gaming machine that the player wishes to play;

(c) prior to initiation of game play on a gaming machine, the player tracking system associating the unique identifier of a player with the unique identifier of a gaming machine that the player wishes to play;

(d) initiating a play session at the gaming machine and associating game play at the gaming machine with the account of the player, wherein activity from the play session is captured by the player tracking system;

(e) electronically communicating information from the player tracking system directly to the mobile device during the play session, the information including data regarding the player that is maintained in the player tracking system;

(f) displaying the information on a display screen of the mobile device during the play session, wherein steps (a), (b) and (f) are performed using the application executing on the mobile device; and (g) electronically requesting, via the application, to change at least one setting on the gaming machine during the play session at the gaming machine.

2. The method of claim 1 wherein the gaming machine is a slot machine.

3. The method of claim 2 wherein the at least one setting on the gaming machine that is changed during the play session is number of lines on the slot machine.

4. The method of claim 1 wherein the at least one setting on the gaming machine that is changed during the play session is game speed.

5. The method of claim 1 wherein the at least one setting on the gaming machine that is changed during the play session is game volume.

6. The method of claim 1 wherein the at least one setting on the gaming machine that is changed during the play session is total number of credits bet.

7. The method of claim 1 wherein the at least one setting on the gaming machine that is changed during the play session is denomination of each credit.

8. The method of claim 1 wherein the application is a mobile app.

9. The method of claim 1 wherein the application is a browser-based application.

10. A method of using a mobile device as an input/output device for a player tracking system for gaming machines, each gaming machine having a unique identifier, each player having a unique identifier that is associated with an account of the player, the mobile device including an application, the method comprising:

(a) electronically communicating player credentials, via the mobile device, directly to the player tracking system, wherein each player credential is associated with a player's unique identifier that is maintained by the player tracking system;

(b) electronically communicating directly to the player tracking system, using the mobile device, a gaming machine that the player wishes to play;

(c) prior to initiation of game play on a gaming machine, the player tracking system associating the unique identifier of a player with the unique identifier of a gaming machine that the player wishes to play;

(d) initiating a play session at the gaming machine and associating game play at the gaming machine with the account of the player, wherein activity from the play session is captured by the player tracking system;

(e) electronically communicating information from the player tracking system directly to the mobile device during the play session, the information including data regarding the player that is maintained in the player tracking system, wherein the data includes the player's present balance of comp points; and (f) displaying the information on a display screen of the mobile device during the play session, wherein steps (a), (b) and (f) are performed using the application executing on the mobile device.

11. The method of claim 10 wherein the data further includes the player's present account balance.

12. The method of claim 10 wherein the gaming machine is a slot machine.

13. The method of claim 10 wherein the application is a mobile app.

14. The method of claim 10 wherein the application is a browser-based application.

15. The method of claim 10 further comprising:

(g) electronically requesting, via the application, to change at least one setting on the gaming machine during the play session at the gaming machine.

* * * * *